United States Patent [19]

Baltz et al.

[11] 4,286,553

[45] Sep. 1, 1981

[54] INTEGRATED FUEL PRIMER AND CRANKCASE DRAIN SYSTEM FOR INTERNAL COMBUSTION ENGINE

[75] Inventors: Gene F. Baltz, Lake Villa; Chester G. DuBois, Zion, both of Ill.

[73] Assignee: Outboard Marine Corporation, Waukegan, Ill.

[21] Appl. No.: 60,285

[22] Filed: Jul. 25, 1979

[51] Int. Cl.[3] ..... F02M 1/16; F02B 33/04

[52] U.S. Cl. ..... 123/187.5 R; 123/180 E; 123/73 A; 123/73 PP; 123/DIG. 2

[58] Field of Search ..... 123/187.5 R, 179 L, 123/179 G, 180 R, 180 E, 73 R, 73 A, 73 C, 75 RC, 75 CC, 73 PP, DIG. 2

[56] References Cited

U.S. PATENT DOCUMENTS

| | | | |
|---|---|---|---|
| 2,175,743 | 10/1939 | Coffman | 123/180 E |
| 2,287,900 | 6/1942 | Parker | 123/187.5 R |
| 2,457,739 | 12/1948 | Sherrill | 123/180 E |
| 3,730,149 | 5/1973 | Brown | 123/73 A |
| 3,800,753 | 4/1974 | Sullivan et al. | 123/DIG. 2 |
| 3,929,111 | 12/1975 | Turner et al. | 123/73 R |
| 3,978,839 | 9/1976 | DuBois et al. | 123/187.5 R |

*Primary Examiner*—Charles J. Myhre
*Assistant Examiner*—Andrew M. Dolinar
*Attorney, Agent, or Firm*—Michael, Best & Friedrich

[57] ABSTRACT

An internal combustion engine comprises a combustion chamber and a crankcase which extends from the combustion chamber. A primary fuel delivery system introduces fuel from a fuel source into the combustion chamber, and a primer fuel delivery system is selectively operable for introducing fuel from the source into the combustion chamber in addition to fuel which is introduced by the primary fuel delivery system. A collector assembly communicates with the crankcase for accumulating residual fuel from the crankcase, and a residual fuel delivery system supplies fuel from the collector assembly into the combustion chamber. A control valve mechanism is connected to the primer fuel delivery system and the residual fuel delivery system for blocking the supply of fuel by the residual fuel delivery system during operation of the primer fuel delivery system.

25 Claims, 8 Drawing Figures

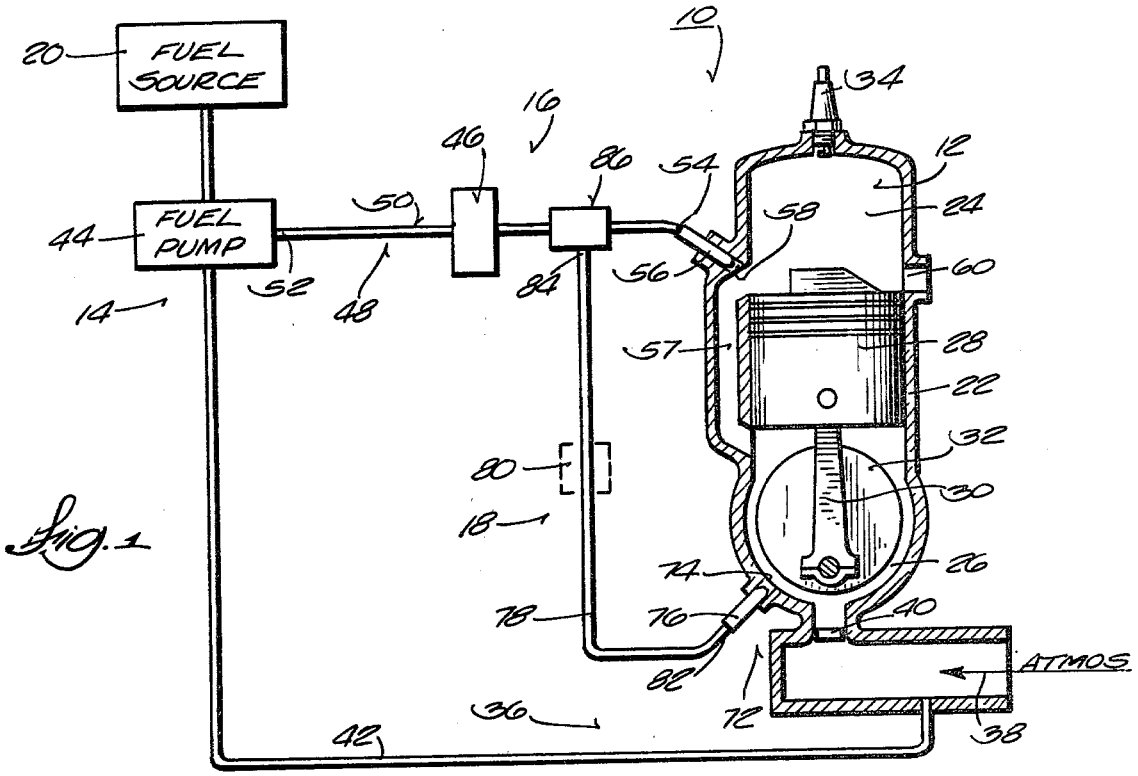
Fig. 1
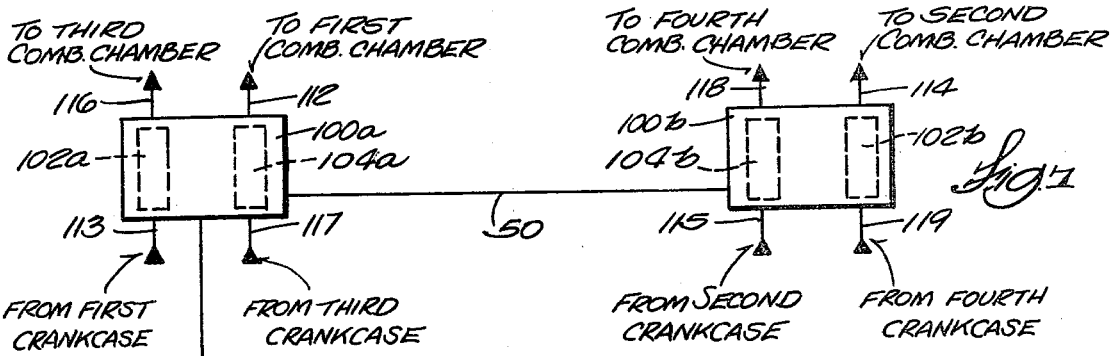
Fig. 1
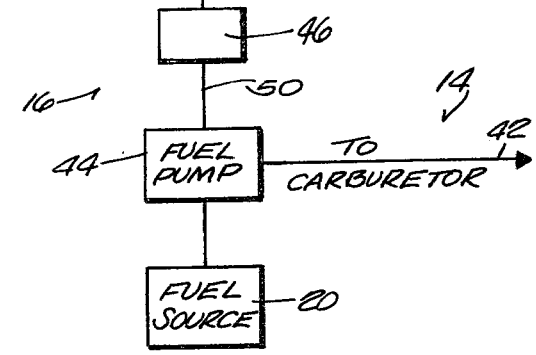
Fig. 3
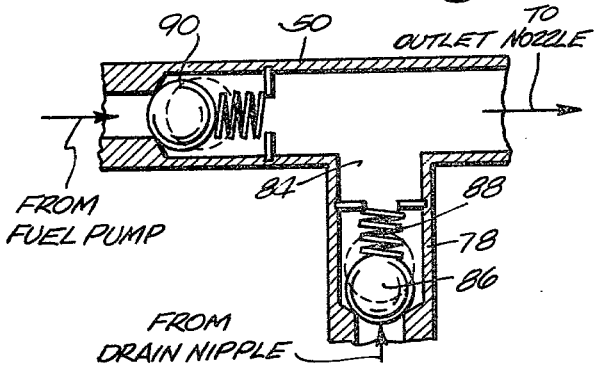

INTEGRATED FUEL PRIMER AND CRANKCASE DRAIN SYSTEM FOR INTERNAL COMBUSTION ENGINE

BACKGROUND OF THE INVENTION

I. Field of the Invention

The invention relates to internal combustion engines and, more particularly, to fuel primers and crankcase drain systems for internal combustion engines.

II. Description of the Prior Art

Fuel primer systems for internal combustion engines are known and disclosed in the following U.S. Pat. Nos.:

| | | |
|---|---|---|
| Parker | 2,287,900 | June 30, 1942 |
| Casteel | 2,553,079 | May 15, 1951 |
| Roosa | 2,821,183 | January 28, 1958 |
| Gastinne | 3,548,796 | December 22, 1970 |
| Schlagmuller et al | 3,614,945 | October 26, 1971 |
| Rachel | 3,646,915 | March 7, 1972 |
| Nagy et al | 3,646,918 | March 7, 1972 |
| Aono | 3,704,702 | December 5, 1972 |
| Porsche et al | 3,799,138 | March 26, 1974 |
| Mondt | 3,888,223 | June 10, 1975 |

A crankcase drain system for an internal combustion engine is disclosed in U.S. Pat. No. 3,376,380 issued to Schultz on Oct. 2, 1973.

None of the above prior art discloses a means for integrating a fuel primer system with a crankcase drain system for an internal combustion engine.

SUMMARY OF THE INVENTION

The invention provides an engine comprising a combustion chamber and a crankcase which extends from the combustion chamber. First fuel delivery means communicates with the combustion chamber and is adapted for connection to a fuel source, the first fuel delivery means being thereby operative for introducing fuel from the fuel source into the combustion chamber. Second fuel delivery means also communicates with the combustion chamber and is adapted for connection to a fuel source, the second fuel delivery means being thereby operative for introducing fuel into the combustion chamber in addition to the fuel introduced by the first fuel delivery means. First control means is connected to the second fuel delivery means for selectively operating the second fuel delivery means to introduce fuel into the combustion chamber. Collector means communicates with the crankcase for accumulating residual fuel from the crankcase, and third fuel delivery means communicates with the collector means and the combustion chamber for supplying residual fuel from the collector means into the combustion chamber. Second control means is connected to the second fuel delivery means and the third fuel delivery means for blocking the supply of residual fuel by the third fuel delivery means during operation of the second fuel delivery means to introduce fuel into the combustion chamber.

In accordance with one embodiment of the invention, the first fuel delivery means includes first fuel conduit means for conducting fuel from the fuel source to the combustion chamber, and first fuel pumping means which communicates withh the first fuel conduit means for pumping fuel through the first fuel conduit means from the fuel source into the combustion chamber. In this embodiment, the second fuel delivery means includes second fuel conduit means which communicates with the first fuel pumping means and the combustion chamber and which conducts fuel from the first fuel pumping means into the combustion chamber subject to the operation of the first control means.

In accordance with one embodiment, the first control means includes first valve means which communicates with the second fuel conduit means and which is operatively movable between a closed position for interrupting the conduction of fuel from the first fuel pumping means into the combustion chamber and an open position for permitting the conduction of fuel from the first fuel pumping means into the combustion chamber. In this embodiment, the first valve means is biased toward the closed position, and activating means is provided for moving the first valve means against the action of the biasing means from the closed position to the open position.

In accordance with one embodiment, the activating means includes an electrically actuated solenoid, as well as manual means for moving the first valve means from the closed position to the open position against the action of the biasing force.

In accordance with one embodiment, the third fuel delivery means includes third fuel conduit means for conducting fuel from the collector means to the combustion chamber, and second fuel pumping means for pumping fuel through the third fuel conduit means from the collector means into the combustion chamber in response to pulsating pressure. In this embodiment, the engine further includes a piston which is mounted for reciprocative movement within the combustion chamber, and the crankcase forms the source of pulsating pressure in response to the reciprocative movement of the piston.

In accordance with one embodiment, the second fuel conduit means includes a first fuel supply passage having an inlet end communicating with the first fuel pumping means and an outlet end communicating with the combustion chamber. The third conduit means includes a second fuel supply passage having an inlet end communicating with the collector means and an outlet end communicating with the first fuel supply passage. In this embodiment, the second control means includes second valve means operatively movable between an open position affording communication between the inlet end of the second fuel supply passage and the first fuel supply passage in response to the flow of fuel in the second fuel supply passage subject to a magnitude of pressure and a closed position blocking the communication between the inlet end of the second fuel supply passage and the first fuel supply passage in response to the flow of fuel in the first supply passage subject to a magnitude of pressure which exceeds the magnitude of fluid pressure in the second fuel supply passage.

In accordance with one embodiment, the second control means includes means for biasing the second valve means toward the closed position, and, in this embodiment, the biasing means works in combination with the fluid pressure in the first fuel supply passage for closing the second valve means.

In accordance with one embodiment, the second fuel delivery means includes third valve means communicating with the first fuel supply passage intermediate the outlet end of the second fuel passage and the inlet end of the first fuel supply passage and operative for preventing the flow of fuel in the first fuel supply passage toward the inlet end of the first fuel supply passage while permitting the flow of fuel in the first fuel supply passage toward the outlet end thereof.

In accordance with one embodiment, the combustion chamber includes a sidewall having an inlet port passing therethrough, and the second fuel delivery means includes nozzle means communicating with the inlet port for introducing fuel into the combustion chamber through the inlet port during operation of the second fuel delivery means.

In accordance with one embodiment, the engine further includes a second combustion chamber in addition to the first mentioned combustion chamber, and a second crankcase in addition to the first mentioned crankcase. In this embodiment, the first fuel delivery means is operative for introducing fuel into both the first and second combustion chambers, and the second fuel delivery means is likewise operative for introducing additional fuel into both the first and second combustion chambers, subject to the operation of the first control means. Also in this embodiment, the collector means includes a first collector means communicating with the first crankcase for accumulating residual fuel from the first crankcase, and second collector means communicating with the second crankcase for accumulating residual fuel from the second crankcase. The third fuel delivery means includes first drain conduit means for supplying residual fuel from the first collector means to the second combustion chamber, and second drain conduit means for supplying residual fuel from the second collector means to the first combustion chamber. In this embodiment, the second control means includes means for simultaneously blocking the supply of residual fuel by the first drain conduit means and the second drain conduit means during operation of the second fuel delivery means.

One of the principal features of the invention is the provision of an engine having a fuel primer system which is integrally connected with a crankcase fuel drainage system, thereby reducing the overall complexity of engine construction.

Another of the principal features of the invention is the provision of the engine having integrally connected fuel primer and drainage systems and which includes control means for blocking the return of residual fuel through the drainage system during operation of the primer system.

Other features and advantages of the embodiments of the invention will become apparent upon reviewing the following general description, the drawings and the appended claims.

DESCRIPTION OF THE DRAWINGS

FIG. 1 is a diagrammatic view of an internal combustion engine having one combustion chamber and which embodies various of the features of the invention;

FIG. 3 is an exploded, partially diagrammatic view of the second control valve which is incorporated in the engine shown in FIG. 1;

FIG. 7 is a schematic view of the internal combustion engine shown in FIG. 4.

Figure 5:
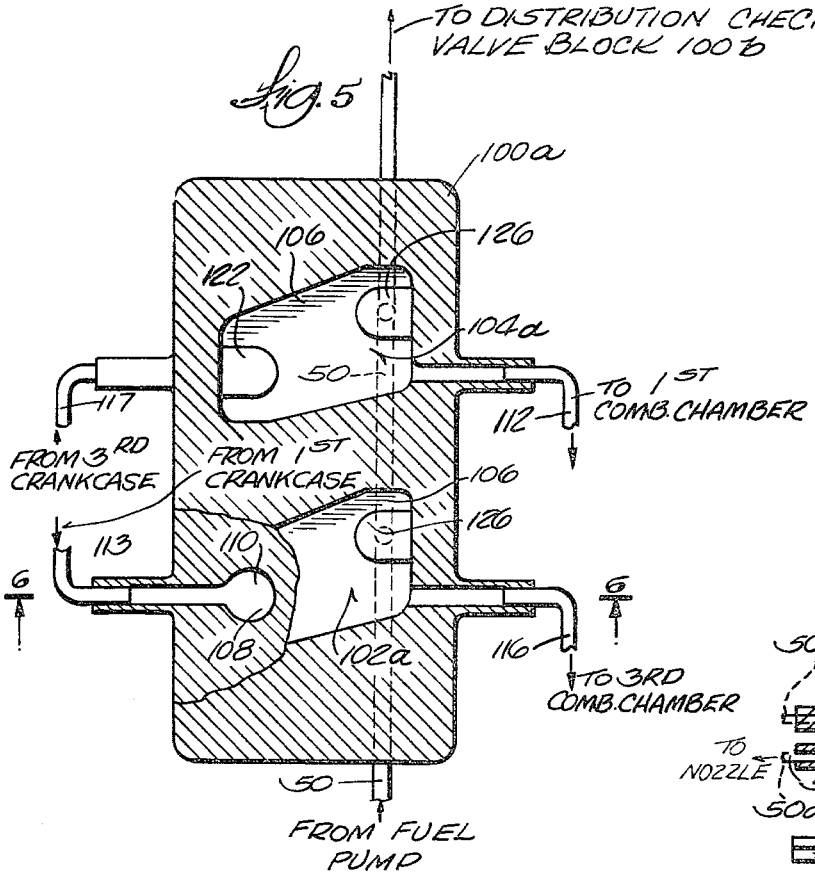
FIG. 5 is a sectional and partially broken away view of the check valve block assembly which is incorporated in the engine shown in FIG. 4.

Before explaining the embodiments of the invention in detail, it is to be understood that the invention is not limited in its application to the details of construction and the arrangement of components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

GENERAL DESCRIPTION

Shown in FIG. 1 is an internal combustion engine 10 which embodies various of the features of the invention. Generally, the engine 10 includes a combustion chamber 12 and associated first, second and third fuel delivery means, respectively 14, 16, and 18, which introduce fuel into the combustion chamber 12 to sustain engine operation.

While various engine constructions are possible, in the illustrated embodiment, a block member 22 includes a cylinder 24 which defines the combustion chamber 12. The block member 22 also includes a crankcase 26 which extends from the cylinder 24. A piston 28 is mounted for reciprocative movement inside the cylinder 24, being connected by a connecting rod 30 to a crankshaft 32 which is rotatably mounted in the crankcase 26. A spark plug 34 or the like extends into the combustion chamber 12, and fuel which is introduced into the combustion chamber 12 by the first, second or third fuel delivery means 14, 16 or 18 is ignited by the spark plug 34, thereby causing reciprocative movement of the piston 28 which in turn drives the crankshaft 32.

The first fuel delivery means 14 includes first fuel conduit means 36 which is suitably connected to a source of fuel 20 and conducts fuel from the fuel source 20 to the combustion chamber 12. While various constructions are possible, in the illustrated embodiment, the first fuel conduit means 36 includes a carburetor having an air induction passage 38 which directs air from the atmosphere into the crankcase 26, typically through a conventional reed valve assembly 40. A conduit 42 delivers fuel from the fuel source 20 into the air induction passage 38, and first fuel pumping means 44, such as an electrical fuel pump or the like, is provided for pumping fuel through the conduit 42.

By virtue of this construction, an air-fuel mixture is formed in the air induction passage 38, being thereafter drawn through the reed valve assembly 40 and a suitable fuel induction port 57 into the combustion chamber 12 in response to pulsating pressure variations which occur in the crankcase 26 and which are occasioned by piston reciprocation. As should now be apparent, the first fuel delivery means 14 represents the primary fuel supply system for the engine 10.

When the engine 10 is cold or has been inoperative for some time, it is often desirable to crank the engine 10, such as by a manually or electrically acutated starter mechanism (not shown), for an extended period of time in order that sufficient combustible quantity of fuel is delivered by the first fuel delivery means 14 to the combustion chamber 12. To supplement the supply of combustible fuel which is introduced into the combustion chamber 12 during cranking operations, and to thereby facilitate starting of the engine 10, the second fuel delivery means 16 introduces fuel into the combustion chamber 12 in addition to the fuel which is introduced by the first fuel delivery means 14. Associated first control means 46 is connected with the second fuel delivery means 16 so that the second fuel delivery means 16 can be selectively operated. As thus described, the second fuel delivery means 16 represents a fuel primer system for the engine 10.

While various constructions are possible, in the illustrated embodiment, the second fuel delivery means 16 includes second fuel conduit means 48 which communicates with the fuel pump 44 and the combustion chamber 12 and which conducts fuel from the fuel pump 44 into the combustion chamber 12, subject to the operation of the first control means 46.

More particularly, a first conduit 50 has an inlet end 52 which is connected with the fuel pump 44 and has an outlet end 54 which is connected to a fuel metering orifice or nozzle 56. The nozzle 56 passes through an inlet port 58 formed in a sidewall of the block member 22 near the upper end of the fuel induction port 57, such that fuel emitted by the nozzle 56 enters the combustion chamber 12 in addition to the fuel which is introduced by the first fuel delivery means 14 and which is drawn by pulsating pressure through the fuel induction port 57.

By virtue of this construction, fuel delivered by the second fuel delivery means 16 is emitted directly into the combustion chamber 12, and the requirement for a conventional choke valve assembly (not shown) in the air induction passage 38 is thereby eliminated. Likewise, the possibility of "over-choking" or flooding the engine 10 during priming is substantially reduced, inasmuch as any excess fuel emitted into the combustion chamber 12 by the nozzle 56 will be quickly expelled from the combustion chamber 12 through the exhaust port 60 by pulsating pressure occasioned by piston reciprocation during cranking.

Figure 2:
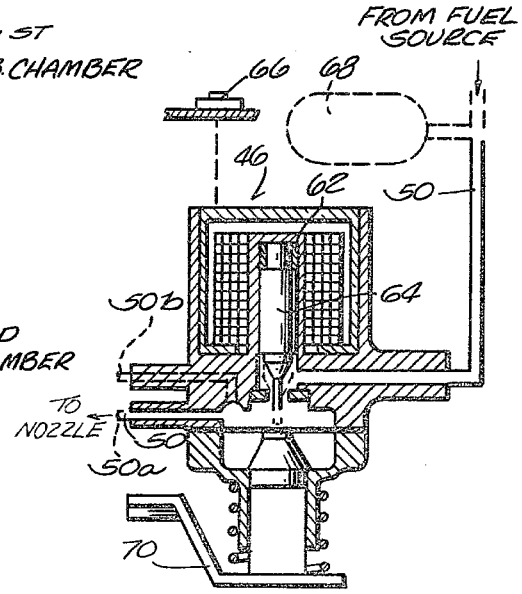
FIG. 2 is a broken away side view of the first control valve which is incorporated in the engine shown in FIG. 1.

Referring now to FIG. 2, the first control means 46, which controls the conduction of fuel through the second fuel delivery means 16, takes the form of a primer fuel control valve assembly which is connected in line with the first conduit 50 between the fuel pump 44 and the nozzle 56. The control valve 46 is operatively movable between a closed position (shown in phantom lines in FIG. 2) for interrupting the flow of fuel to the nozzle 56 through the first conduit 50 and an open position (shown in solid lines in FIG. 2) for permitting the flow of fuel to the nozzle 56 through the first conduit 50.

In order that the control valve 46 may be selectively moved between the closed and open positions, in the illustrated embodiment (see FIG. 2), the control valve 46 is biased toward the closed position, such as by a spring 62, and an electrically controlled solenoid 64 is operatively connected with the control valve 46 for moving the valve 46 from the closed position to the open position against the action of the biasing spring 62. The solenoid 64 is in turn operated by means of a conventional switch 66 which is accessible for operation by the engine operator. Thus, as the operator actuates the engine starter mechanism, the operator may simultaneously actuate the switch 66 to operate the second fuel delivery means 16 to prime the engine 10.

As heretofore described, the fuel pump 44 and the control valve 46 are electrically actuated, typically by means of a battery (not shown). In order that the engine may be manually primed should electrical failure occur, a manually actuated fuel pump, such as a resilient "squeeze" bulb 68 or the like (shown in phantom lines in FIG. 2), may be connected with the first conduit 50, and a manually actuated lever assembly 70 may be operatively connected with the control valve 46 so that the control valve 46 may be manually opened against the action of the biasing spring 62. The squeeze bulb 68 and lever assembly 70 provide a secondary or back-up primer system should electrical failure occur.

During normal operation of the engine 10, unignited fuel can collect in the crankcase 26 and cause the formation of erratic fuel-air ratios which interfere with efficient engine combustion. To return this residual fuel from the crankcase 26 to the combustion chamber 12, the engine 10 includes a crankcase drainage system. Generally, and referring to FIG. 1, collector means 72 communicates with the crankcase 26 for accumulating the residual fuel from the crankcase 26, and the third fuel delivery means 18 communicates with the collector means 72 and with the combustion chamber 12 to supply residual fuel from the collector means 72 into the combustion chamber 12.

While various constructions are possible, in the illustrated embodiment (as best shown in FIG. 1), the collector means 72 includes an outlet port 74 which is formed in a sidewall of the crankcase 26 in the vicinity of the reed valve assembly 40. A drain nipple 76 or the like communicates with the outlet port 74, and the third fuel delivery means 18 includes a second conduit 78 which communicates with the drain nipple 76 and with the combustion chamber 12. Second fuel pumping means 80 (shown in phantom lines in FIG. 1) pumps the residual fuel through the second conduit 78.

While the second fuel pumping means 80 can be variously constructed and be, for example, a separate fuel pump which operates independently of the first mentioned fuel pump 44, in the illustrated embodiment, the pulsating pressure variations which occur in the crankcase 26 as a result of piston reciprocation serve to pump the residual fuel out of the crankcase 26 through the second conduit 78 and into the combustion chamber 12.

As shown in FIG. 1, the third fuel delivery means 18 intersects the second fuel delivery means 16 such that residual fuel, like the primer fuel, is emitted directly to the combustion chamber 12 through the heretofore described nozzle 56. In particular, the second conduit 78 has an inlet end 82 which is connected with the drain nipple 76 and an outlet end 84 which intersects with the first conduit 50 intermediate the nozzle 56 and the primer fuel control solenoid valve 46.

In order that the second fuel delivery means 16 and the third fuel delivery means 18 operate independently of each other and do not conduct fuel to the nozzle 56 at the same time, second control means 86 (shown diagrammatically in FIG. 1) is connected to the second and third fuel delivery means 16 and 18 near their point of intersection for blocking the supply of residual fuel by the third fuel delivery means 18 during operation of the second fuel delivery means 16.

More particularly, in the embodiment shown in FIG. 3, the second control means includes a check valve 86 or the like which is connected in line with the second conduit 78 near its outlet end 84. The check valve 86 is operatively movable in response to fluid pressure between a closed position (shown in solid lines in FIG. 3) which blocks communication between the inlet end 82 and the outlet end 84 of the second conduit 78, and consequently blocks the flow of fuel therebetween, and an open position (shown in phantom lines in FIG. 3) which affords communication between the inlet end 82 and the outlet end 84 of the second conduit 78, and thereby permits the flow of fuel through the second conduit 78 to the nozzle 56.

Since the flow of fuel through the first conduit 50 in response to operation of the fuel pump 44 is generally subject to a greater magnitude of pressure than the flow of fuel through the second conduit 78 which is in response to pulsating pressure emanating from the crankcase 26, the check valve 86 will be maintained in the closed position whenever fuel flows through the first conduit 50. Thus, the third fuel delivery means 18 is blocked whenever the second fuel delivery means 16 is being operated. Similarly, when the flow of fuel through the first conduit 50 ceases by operation of the primer fuel control solenoid valve 46, the now unopposed pulsating pressure variations in the crankcase 26 will open the check valve 86 and pump residual fuel into the combustion chamber 12.

In the illustrated embodiment, the check valve 86 is biased in the closed position, such as by a spring 88. Thus, the biasing force of the spring 88 works in combination with the fluid pressure in the first conduit 50 in closing the check valve 86, thereby reducing the pressure differential necessary to maintain the check valve 86 in the closed position.

Still referring to FIG. 3, in order that the flow of fuel through the second conduit 78 will not "back up" into the first conduit 50, a second check valve 90 is placed in line with the first conduit 50 between its inlet end 52 and its point of intersection with the first conduit 50. The check valve 90 is biased in a normally closed position and is unseated by fluid pressure occasioned by operation of the primer fuel control solenoid valve 46. By virtue of this construction, fuel may flow in the first conduit 50 only toward the nozzle 56, and no fuel "back up" from the third fuel delivery means 18 can occur.

Figure 4:
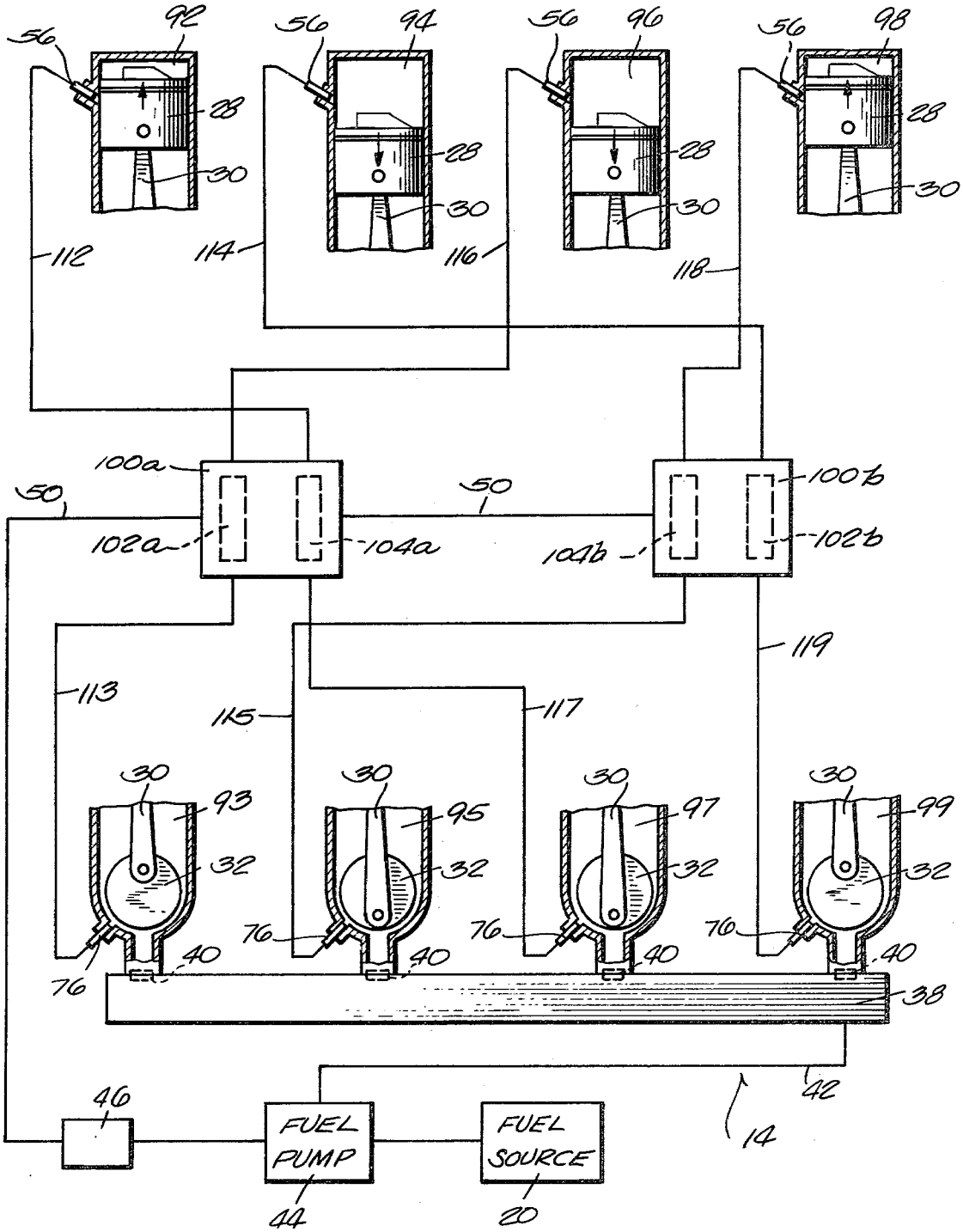
FIG. 4 is a diagrammatic view of an internal combustion engine having four combustion chambers and which embodies various of the features of the invention.

Shown in FIG. 4 is an internal combustion engine 10 which is similarly constructed as the one heretofore described, but which includes four combustion chambers 92, 94, 96 and 98 and four associated crankcases 93, 95, 97 and 99. For purposes of further description, the combustion chambers 92, 94, 96 and 98 will hereafter be referred to respectively as the first, second, third and fourth combustion chambers and the associated crankcases 93, 95, 97 and 99 will similarly be referred to respectively as the first, second, third and fourth crankcases.

As is shown diagrammatically by arrows in FIG. 4, piston reciprocation is sequenced by conventional timing means (not shown) such that the pistons 28 in the first and fourth combustion chambers 92 and 98 reciprocate together in one direction, and the pistons 28 in the second and third combustion chambers 94 and 96 reciprocate together in a direction opposite to that of the pistons 28 in the first and fourth combustion chambers 92 and 98 (i.e. as shown in FIG. 4, when the pistons 28 in the first and fourth combustion chambers 92 and 98 are in their upstroke, the pistons 28 in the second and third combustion chambers 94 and 96 are in their downstroke). As in the previously described embodiment, the first fuel delivery means 14 introduces fuel into each combustion chamber 92, 94, 96, and 98 through suitable reed valve assemblies 40 which communicate with each crankcase 93, 95, 97 and 99. Likewise, a fuel metering orifice or nozzle 56 communicates with each combustion chamber 92, 94, 96 and 98, and a drain nipple 76 communicates with each crankcase 93, 95, 97 and 99. The second fuel delivery means 16 communicates with the fuel pump 44 of the first fuel delivery means 14 and with each nozzle 56 to simultaneously introduce fuel into each of the four combustion chambers 92, 94, 96, and 98 through the respective nozzle 56 subject to the operation of the primer fuel control valve 46. In similar fashion, the third fuel delivery means 18 communicates with each drain nipple 76 and intersects the second fuel delivery means 16 to return residual fuel from the crankcases 93, 95, 97 and 99 to each of the combustion chambers 92, 94, 96 and 98 through the respective nozzle 56.

In this embodiment, the third fuel delivery means 18 connects the crankcase of one combustion chamber with another combustion chamber in which opposite piston reciprocation occurs. In this way, the pulsating pressure differential needed to induce the flow of fuel through the third fuel delivery means 18 is created.

While is should be appreciated that an arrangement of check valves similar in construction to those heretofore described and shown in FIG. 3 may be utilized, in the four cylinder embodiment shown in FIG. 4 through 7, two fuel distribution check valve blocks **100*a* and 100*b* direct the desired flow of fuel through the second and third fuel delivery means 16 and 18**. It should be appreciated that one fuel distribution check valve block is provided for every two combustion chambers, so that in a six cylinder embodiment, three check valve blocks would be provided and so on.

Generally, each check valve block **100*a* and 100*b* includes two individual check valve chambers, respectively 102*a* and 104*a* for block 100*a*, and 102*b* and 104*b* for block 100*b*. Each check valve chamber 102*a*, 104*a* and 102*b*, 104*b* is compartmentalized into an upper chamber portion 106 which communicates with one combustion chamber and a lower chamber portion 108 which communicates with the crankcase of another combustion chamber in which opposite piston reciprocation occurs. The upper and lower chamber portions 106 and 108 of each check valve chamber are interconnected by means of a port 110**.

Figure 6:
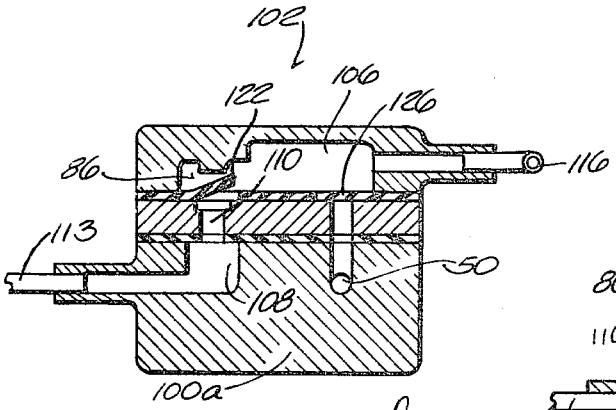
FIG. 6 is a sectional view of the check valve block assembly taken generally along line 6—6 of FIG. 5 and in which the third fuel delivery system is in operation.

Referring first specifically to the first check valve block **100*a*, check valve chamber 102*a* channels the flow of fuel from the first crankcase 93 to the third combustion chamber 96 (as shown digrammatically in FIG. 4 and schematically in FIG. 7). More particularly, and as best shown in FIGS. 5 and 6, a drain conduit 113 connects the drain nipple 76 of the first crankcase 93 with the lower chamber portion 108 of the check valve chamber 102*a*, and an outlet branch conduit 116 connects the upper chamber portion 106 with the nozzle 56 of the third combustion chamber 96. The port 110 which interconnects the upper and lower chamber portions 106 and 108 permits the flow of fuel between the two chamber portions. Thus, due to the oppositely matched pulsating pressures, residual fuel is directed from the first crankcase 93 into the third combustion chamber 96 through check valve chamber 102*a***.

The equivalent construction and operation are found in the remaining check valve chambers **104*a*, 102*b* and 104*b*. More particularly, and as is best seen in FIGS. 4, 5 and 7, check valve chamber 104*a* channels the flow of residual fuel from the third crankcase 97 to the first combustion chamber 92 by means of drain conduit 117 which enters the lower chamber portion 108 and outlet branch conduit 112 which leads from the upper chamber portion 106. Likewise, check valve chamber 102***b* (see FIGS. 4 and 7) directs the flow of residual fuel from the fourth crankcase 99 into the second combustion chamber 94 by means of drain conduit 119 and outlet branch conduit 114, and check valve chamber 104*b* (see also FIGS. 4 and 7) directs the flow of residual fuel from the second crankcase 95 into the fourth combustion chamber 98 by means of drain conduit 115 and outlet branch conduit 118.

The upper chamber portions 106 of the individual check valve chambers 102*a*, 104*a* and 102*b*, 104*b* are connected by the first conduit 50 in series with each other. Thus, fuel which is pumped through the first conduit 50 in response to the operation of the primer fuel control solenoid valve 46 will simultaneously enter the upper chamber portions 106 of each valve chamber and will thereafter be channeled through the four associated outlet branch conduits 112, 114, 116 and 118 into the four combustion chambers 92, 94, 96 and 98, thereby priming the engine.

In this embodiment, the second control means 86 includes a series of check or flap valves 122 or the like which individually communicate with the ports 110 in each check valve chamber 102*a*, 104*a* and 102*b*, 104*b*. Like the heretofore described check valve 86, each check valve 122 is operable in response to fluid pressure between a closed position (shown in solid lines in FIG. 8) which blocks the associated port 110, and thus blocks communication between the associated upper and lower chamber portions 106 and 108, and an open position (shown in solid lines in FIG. 6) which affords communication between the associated upper and lower chamber portions 106 and 108.

Figure 8:
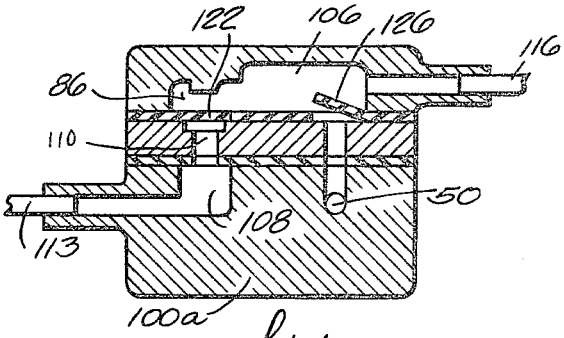
FIG. 8 is a sectional view of the check valve block assembly, similar to FIG. 6, in which the second fuel delivery system is in operation.

By virtue of this construction, since the flow of fuel through the first conduit 50 is generally subject to a greater magnitude of pressure than the pulsating pressure generated by piston reciprocation, all of the check valves 122 will be simultaneously placed in the closed position (as shown in FIG. 8) whenever the primer fuel control solenoid valve 46 is open to permit fuel to flow through the first conduit 50 into the upper chamber portions 106 of the check valve chambers. As a result, residual fuel will be trapped in the lower chamber portions 108 of the check valve chambers, and only fuel flowing through the first conduit 50 is directed through the outlet branch conduits 112, 114, 116, and 118 to the nozzles 56. Thus, the return of residual fuel is blocked when the engine is being primed.

Conversely, when the primer fuel control solenoid valve 46 is closed, the unopposed pulsating pressure variations between the matched crankcases and combustion chambers will open the affected check valve 122 (as shown in FIG. 6), and residual fuel will be pumped from the affected lower chamber portion 108 into the associated upper chamber portion 106 and ultimately into the associated combustion chamber 92, 94, 96, or 98.

As in the first described embodiment, each check valve 122 may be biased by suitable means in the closed position, thereby reducing the pressure differential necessary to maintain each check valve 122 in its closed position.

Also as in the first described embodiment, the second fuel delivery means 16 includes check valves 126 which are located at the points where the first conduit 50 enters the upper chamber portions 106 of the respective check valve chambers. The check valves 126 are simultaneously operative to allow the flow of primer fuel from the first conduit 50 into the upper chamber portions 106 in response to operation of the primer fuel control solenoid valve 46 (as is shown in FIG. 8) while blocking the backflow of residual fuel from the upper chamber portions 106 into the first conduit 50 during operation of the third fuel delivery means 18 (as shown in FIG. 6).

It should be appreciated that, while only a single cylinder embodiment and a four cylinder embodiment of the invention have been fully illustrated and described herein, the invention is applicable for use in an engine having any number of cylinders.

Various of the features of the invention are set forth in the following claims.

What is claimed is:

1. An engine comprising a combustion chamber, a crankcase extending from said combustion chamber, first fuel delivery means communicating with said combustion chamber and adapted for connection to a fuel source, said first fuel delivery means being operative for introducing fuel from the fuel source into said combustion chamber, second fuel delivery means communicating with said combustion chamber and adapted for connection to a fuel source, said second fuel delivery means being operative for introducing fuel into said combustion chamber in addition to the fuel introduced by said first fuel delivery means, collector means communicating with said crankcase for accumulating residual fuel from said crankcase, third fuel delivery means communicating with said collector means and said combustion chamber and operative for supplying residual fuel from said collector means to said combustion chamber, first control means connected to said second fuel delivery means for selectively operating said second fuel delivery means to introduce fuel into said combustion chamber, and second control means connected to said second fuel delivery means and said third fuel delivery means for blocking the supply of residual fuel by said third fuel delivery means during operation of said second fuel delivery means to introduce fuel into said combustion chamber.

2. An engine according to claim 1 wherein said first fuel delivery means includes first fuel conduit means for conducting fuel from the fuel source to said combustion chamber, and first fuel pumping means communicating with said first fuel conduit means for pumping fuel through said first fuel conduit means from the fuel source into said combustion chamber.

3. An engine according to claim 2 wherein said second fuel delivery means includes second fuel conduit means communicating with said first fuel pumping means and said combustion chamber and operative for conducting fuel from said first fuel pumping means to said combustion chamber subject to the operation of said first control means.

4. An engine according to claim 3 wherein said first control means includes first valve means communicating with said second fuel conduit means and operatively movable between a closed position for interrupting the conduction of fuel from said first fuel pumping means to said combustion chamber and an open position for permitting the conduction of fuel from said first fuel pumping means to said combustion chamber, and means for selectively moving said first valve means between said closed position and said open position.

5. An engine according to claim 4 wherein said means for selectively moving said first valve means includes means for biasing said first valve means toward said closed position, and activating means for moving said first valve means against the action of said biasing means from said closed position to said open position.

6. An engine according to claim 5 wherein said activating means includes an electrically actuated solenoid.

7. An engine according to claim 5 or 6 wherein said activating means includes means for manually moving said first valve means from said closed position to said open position.

8. An engine according to claim 3 wherein said third fuel delivery means includes third fuel conduit means for conducting fuel from said collector means to said combustion chamber, and second fuel pumping means for pumping fuel through said third fuel conduit means from said collector means into said combustion chamber.

9. An engine according to claim 8 wherein said second fuel pumping means includes a source of pulsating pressure, and means operatively connecting said third fuel conduit means with said source of pulsating pressure for pumping fuel through said third fuel conduit means in response to pulsating pressure.

10. An engine according to claim 9 further including a piston mounted for reciprocative movement within said combustion chamber, and wherein said crankcase forms said source of pulsating pressure in response to the reciprocative movement of said piston.

11. An engine according to claim 8 wherein said second fuel conduit means includes a first fuel supply passage having an inlet end communicating with said first fuel pumping means and an outlet end communicating with said combustion chamber, and wherein said third fuel conduit means includes a second fuel supply passage having an inlet end communicating with said collector means and an outlet end communicating with said first fuel supply passage.

12. An engine according to claim 11 wherein said second control means includes second valve means operatively movable between an open position affording communication between said inlet end of said second fuel supply passage and said first fuel supply passage in response to the flow of fuel in said second fuel supply passage subject to a magnitude of pressure and a closed position blocking the communication between said inlet end of said second fuel supply passage and said first fuel supply passage in response to the flow of fuel in said first fuel supply passage subject to a magnitude of pressure in excess of the magnitude of pressure in said second fuel supply passage.

13. An engine according to claim 12 wherein said second control means includes means for biasing said second valve means toward said closed position, and whereby said biasing means works in combination with the fluid pressure in said first fuel supply passage for closing said second valve means.

14. An engine according to claim 11 wherein said second fuel delivery means includes valve means communicating with said first fuel supply passage intermediate said outlet end of said second fuel supply passage and said inlet end of said first fuel supply passage and operative for preventing the flow of fuel in said first fuel supply passage toward said inlet end thereof while permitting the flow of fuel in said first fuel supply passage toward said outlet end thereof.

15. An engine according to claim 8 and further including a valve block attached to said engine and having a first chamber, a second chamber, and a port interconnecting said first chamber with said second chamber, wherein said second fuel conduit means including a first conduit connected with said first fuel pumping means and said first chamber for conducting fuel into said first chamber subject to the operation of said first control means and an outlet conduit connected with said first chamber and said combustion chamber for conducting fuel from said first chamber into said combustion chamber, and wherein said third fuel conduit means includes a drain conduit connected with said collector means and said second chamber for conducting fuel from said collector means into said second chamber and thereby into said first chamber through said port for introduction into said combustion chamber through said outlet conduit.

16. An engine according to claim 15 wherein said second control means includes second valve means connected to said valve block and operatively movable between an open position permitting the passage of fuel from said second chamber into said first chamber through said port, and thus into said combustion chamber through said outlet conduit, in response to the flow of fuel into said second chamber through said drain conduit subject to a magnitude of pressure and a closed position blocking said port and preventing the passage of fuel from said second chamber into said first chamber, and thus into said combustion chamber, in response to the flow of fuel into said first chamber through said first conduit subject to a magnitude of pressure in excess of the magnitude of pressure in said second chamber.

17. An engine according to claim 15 wherein said second fuel delivery means includes valve means communicating with said first conduit and operative for preventing the flow of fuel in said first conduit from said first chamber toward said first fuel pumping means while permitting the flow of fuel in said first conduit from said first fuel pumping means into said first chamber.

18. An engine according to claim 1 wherein said combustion chamber includes a sidewall having an inlet port passing therethrough, and wherein said second fuel delivery means includes nozzle means communicating with said inlet port for introducing the fuel into said combustion chamber through said inlet port during operation of said second fuel delivery means.

19. An engine according to claim 1 and further including a second combustion chamber in addition to said first mentioned combustion chamber, and a second crankcase in addition to said first mentioned crankcase and extending from said second combustion chamber, wherein said first fuel delivery means is operative for introducing fuel simultaneously into both of said first and said second combustion chambers, wherein said second fuel delivery means is operative for introducing fuel simultaneously into both of said first and second combustion chambers subject to the operation of said first control means, wherein said collector means includes first collector means communicating with said first crankcase for accumulating residual fuel from said first crankcase and second collector means communicating with said second crankcase for accumulating residual fuel from said second crankcase, wherein said third fuel delivery means includes first drain conduit means for supplying residual fuel from said first collector means to said second combustion chamber and second drain conduit means for supplying residual fuel from said second collector means to said first combustion chamber, and wherein said second control means includes means for simultaneously blocking the supply of residual fuel by said first and second drain conduit means during operation of said second fuel delivery means to simultaneously introduce fuel into said first and second combustion chambers.

20. An engine comprising a combustion chamber, a nozzle communicating with said combustion chamber, a piston mounted for reciprocative movement within said combustion chamber, a crankcase extending from said combustion chamber, said crankcase forming a source of pulsating pressure in response to piston reciprocation, a drain nipple communicating with said crankcase, primary fuel conduit means communicating with said combustion chamber and adapted for connection to a fuel source, said primary fuel conduit means being operative for conducting fuel from the fuel source to said combustion chamber, fuel pumping means communicating with said primary fuel conduit means for pumping fuel through said primary fuel conduit means from the fuel source into said combustion chamber, a first fuel supply passage connected with said fuel pumping means and with said nozzle for conducting fuel from said fuel pumping means to said nozzle and into said combustion chamber in addition to the fuel conducted by said primary fuel conduit means, first control valve means connected with said first fuel supply passage and operatively movable between a closed position for interrupting the conduction of fuel by said first fuel supply passage from said fuel pumping means to said nozzle and an open position for permitting the conduction of fuel by said first fuel supply passage from said fuel pumping means to said nozzle, means for selectively moving said first valve means between said closed position and said open position, a second fuel supply passage connected with said drain nipple and with said first fuel supply passage for conducting fuel from said drain nipple into said first fuel supply passage, and thus to said nozzle and into said combustion chamber, in response to crankcase pulsating pressure, and second control valve means connected with said second fuel supply passage for blocking the supply of fuel by said second fuel supply passage from said drain nipple to said nozzle in response to the conduction of fuel by said first fuel supply passage from said fuel pumping means to said nozzle when said first control valve is in said open position.

21. An enginge according to claim 20 wherein said second control valve means includes a check valve operatively movable between an open position affording communication between said drain nipple and said first fuel supply passage in response to the flow of fuel in said second fuel supply passage subject to a magnitude of pulsating pressure and a closed position blocking the communication between said drain nipple and said first fuel supply passage in response to the flow of fuel in said first fuel supply passage when said first control valve means is located in said open position, the flow of fuel in said first fuel supply passage being subject to a magnitude of pressure generated by said fuel pump means which is in excess of the magnitude of said pulsating pressure.

22. An engine according to claim 21 wherein said second control valve means includes means for biasing said check valve toward said closed position, and whereby said biasing means works in combination with the fluid pressure in said first fuel supply passage for closing said check valve.

23. An engine according to claim 21 or 22 and further including check valve means for preventing the flow of fuel in said first fuel supply passage toward said fuel pumping means while permitting the flow of fuel in said first fuel supply passage toward said nozzle.

24. An engine comprising first and second combustion chambers, a piston mounted in each of said combustion chambers for reciprocative movement therein, means operatively connected with said pistons for causing said piston in said first combustion chamber to reciprocate oppositely to said piston in said second combustion chamber, first and second crankcases associated with the respective one of said first and second combustion chambers, each of said crankcases forming a source of pulsating pressure in response to piston reciprocation, first and second inlet nozzles communicating with the respective one of said first and second combustion chambers, first and second drain nipples communicating with the respective one of said first and second crankcases, primary fuel conduit means individually connected with each of said combustion chambers and adapted for connection to a fuel source, said primary fuel conduit means being operative for conducting fuel from the fuel source to each of said combustion chambers, primary fuel pumping means connected with said primary fuel conduit means for pumping fuel through said primary fuel conduit means from the fuel source to each of said combustion chambers, a fuel distribution valve block including a first valve chamber and a second valve chamber, each of said first and second valve chambers being compartmentalized to include a first chamber portion, a second chamber portion, and a port interconnecting said first chamber portion with said second chamber portion, first conduit means connected with said primary fuel pumping means and commonly with each of said first chamber portions for simultaneously conducting fuel from said primary fuel pumping means into each of said first chamber portions, first control valve means connected to said first conduit means for selectively permitting the flow of fuel through said first conduit means, a first outlet conduit connected with said first chamber portion of said first valve chamber and said second nozzle for conducting fuel from said first chamber portion into said second combustion chamber, a second outlet conduit communicating with said first chamber portion of said second valve chamber and said first nozzle for conducting fuel from said first chamber portion into said first combustion chamber, a first drain conduit connected with said first drain nipple and said second chamber portion of said second valve chamber for supplying residual fuel from said first crankcase into said second chamber portion of said second valve chamber and thereby into said first chamber portion of said second valve chamber through said port for introduction into said second combustion chamber through said second outlet conduit in response to pulsating pressure, a second drain conduit connected with said second drain nipple and with said second chamber portion of said first valve chamber for conducting residual fuel from said second crankcase into said second chamber portion of said first valve chamber and thereby into said first chamber portion thereof through said port for introduction into said first combustion chamber through said first outlet conduit in response to pulsating pressure, and a check valve individually connected with each of said first and said second valve chambers and operatively movable between an open position permitting the passage of fuel from said respective second chamber portion through said respective port into said respective first chamber portion in response to the flow of fuel into said respective second chamber portion subject to a magnitude of pulsating pressure and a closed position blocking said respective port and preventing the passage of fuel from said respective second chamber portion into said respective first chamber portion in response to the flow of fuel into said respective first chamber portion through said first conduit subject to a magnitude of pressure in excess of the magnitude of pulsating pressure.

25. An engine according to claim 24 and further including a second check valve individually connected with each of said first and second check valve chambers for preventing the flow of fuel from each of said first chamber portion into said first conduit while permitting the flow of fuel from said first conduit into each of said first chambers portions subject to the operation of said first control valve means.

* * * * *